US006054645A

United States Patent [19]

Gauger

[11] Patent Number: 6,054,645

[45] Date of Patent: Apr. 25, 2000

[54] HI-HAT PERCUSSION INSTRUMENT

[76] Inventor: Gary L. Gauger, 15108 Highland La., Minnetonka, Minn. 53345

[21] Appl. No.: 08/915,182

[22] Filed: Aug. 20, 1997

[51] Int. Cl.[7] ..... G10D 13/02

[52] U.S. Cl. ..... 84/422.3; 84/421; 84/411 R

[58] Field of Search ..... 84/422.3, 421, 84/411 R

[56] References Cited

U.S. PATENT DOCUMENTS

| | | | |
|---|---|---|---|
| 3,167,995 | 2/1965 | LaLonde . | |
| 3,742,810 | 7/1973 | Crigger . | |
| 5,052,262 | 10/1991 | Havens . | |
| 5,063,819 | 11/1991 | Hoshino . | |
| 5,218,151 | 6/1993 | Kurosaki . | |
| 5,266,733 | 11/1993 | Jacobson | 84/422.3 |
| 5,267,500 | 12/1993 | Lombardi . | |
| 5,367,939 | 11/1994 | Barker | 84/402 |
| 5,936,176 | 8/1999 | Lombardi | 84/421 |

FOREIGN PATENT DOCUMENTS

| | | |
|---|---|---|
| 3503870A1 | 10/1985 | Germany . |
| 3520837C1 | 10/1986 | Germany . |

*Primary Examiner*—Robert E. Nappi
*Assistant Examiner*—Kim Lockett
*Attorney, Agent, or Firm*—Moore & Hansen

[57] ABSTRACT

An improved hi-hat percussion instrument has a treadle stand with a central support shaft with a lower rod therein, the rod and support shaft being connected to a foot pedal. A hi-hat cymbal assembly has a lower fixed cymbal and a movable upper cymbal located above the central shaft. A bias spring is between the cymbals urging the upper movable cymbal away from the lower fixed cymbal. A flexible member is connected to the lower rod and the movable top cymbal which will then bring the two cymbals together by action of the foot pedal. A pivoting knuckle also permits the hi-hat cymbal assembly to assume varied angles.

40 Claims, 7 Drawing Sheets

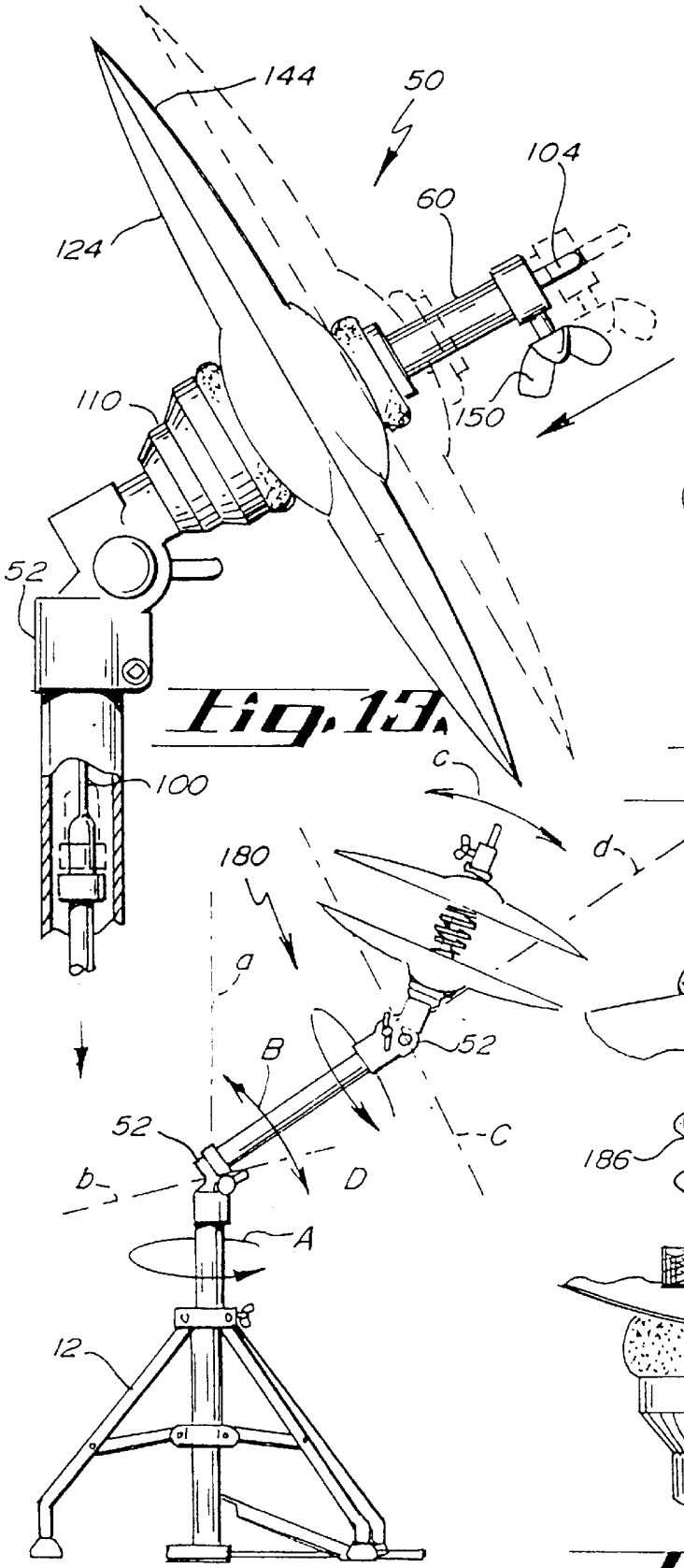
Fig. 13.
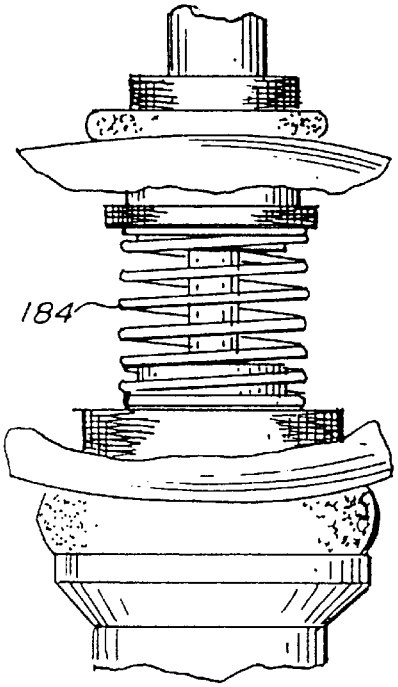
Fig. 17.
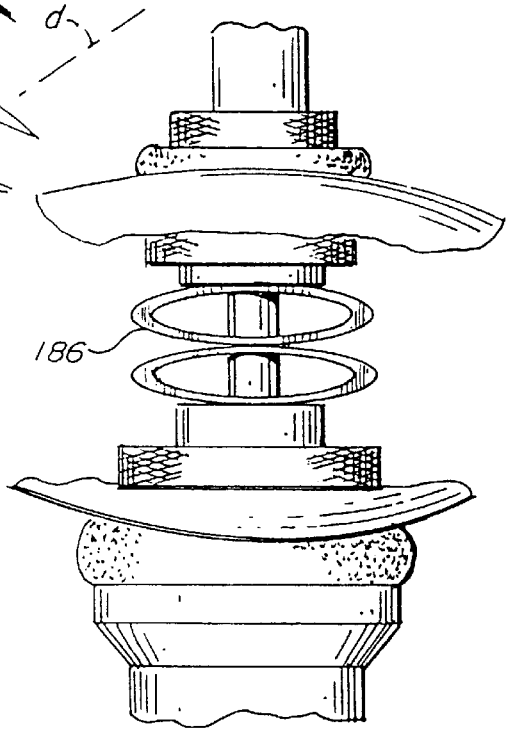
Fig. 18.
Fig. 16.

HI-HAT PERCUSSION INSTRUMENT

BACKGROUND OF THE INVENTION

This invention relates to a hi-hat percussion instrument, and more particularly, to an improved hi-hat percussion instrument having a spring between the cymbals to bias the cymbals apart, a flexible member connecting the lower rod of the treadle stand and the movable top cymbal and a pivoting knuckle that permits the tilting of the cymbal assembly.

Hi-hat percussion instruments comprise a pairing of two cymbals that come together to make a clashing cymbal sound by action of a foot pedal. Most often and presently popular, the upper cymbal is connected to the foot pedal by a rod passing through the treadle stand with spring biasing in the stand adjacent to pedal to bias the upper cymbal up and away from the fixed lower cymbal.

U.S. Pat. No. 3,167,995 issued to Londe shows one variant example of an external upper, resilient biasing means. The biasing support holds the cymbals apart and permits the cymbals to come together by the flexing of the bellcrank lever pivotally connected to an L-shaped arm. The upper cymbal is connected to the foot pedal by means of a straight wire.

U.S. Pat. No. 3,742,810 issued to Crigger discloses an angularly adjustable hi-hat cymbal mounting head with a shaft connecting the upper cymbal and a complex biased linkage connected to the shaft and pedal of the treadle stand. Substantial friction and wear will occur with this mounting head as well as slight delays in action due to the complex biased linkage connections.

U.S. Pat. No. 5,052,262 issued to Havens, as well as U.S. Pat. No. 5,063,819 issued to Hoshino reveal a lower cymbal tilting mechanism for hi-hat cymbal stands.

U.S. Pat. No. 5,218,151 issued to Kurosaki discloses a hi-hat cymbal holder that permits a vertical gap adjustment of the upper movable cymbal by hand-ring rotary motion.

U.S. Pat. No. 5,267,500 shows a remote hi-hat percussion instrument with a connector unit and biasing spring being located below the cymbal assembly.

German Patent Nos. 3520837 and 3503870 disclose tilting hi-hat stands with pivoting knuckles frictionally secured with cables or chains passing therethrough. Tilting the hi-hat cymbal assemblies of these two references causes the cymbals to be moved too close to the drummer while the pedal of the treadle stand is uncomfortably moved away from the drummer. This undesirable characteristic is illustrated in FIG. 1 by comparing Length $L_1$ to Length $L_2$ of FIG. 2.

Lowering the pivoting joint in the percussion instrument also creates a tip-over problem in addition to the spacial problems. Specifically, cymbals may range from 12, 13, 14 and 15 inches in diameter weighing up to three pounds per cymbal. Two cymbals extending outwardly from a lower pivoting joint can make the instrument easily tip over, especially when hit with drum sticks. Further, this tilting creates additional wear and bending of parts over time due to the weights of the cymbals.

There is a need for an improved hi-hat percussion instrument that will permit the hi-hat cymbal assembly to have varying angles without spacial disadvantages. Such an instrument must be simple, extremely smooth and subject to little wear of only a few moving parts.

SUMMARY OF THE INVENTION

An improved hi-hat percussion instrument has a treadle stand with a central support shaft with a lower rod therein, the rod and support shaft being connected to a foot pedal. A hi-hat cymbal assembly has a lower fixed cymbal and a movable upper cymbal located above the central shaft. A bias spring is between the cymbals urging the upper movable cymbal away from the lower fixed cymbal. A flexible member is connected to the lower rod and the movable top cymbal which will then bring the two cymbals together by action of the foot pedal. A pivoting knuckle also permits the hi-hat cymbal assembly to assume varied angles.

A principal object and advantage of the present invention is that the improved hi-hat percussion instrument operates with a minimum of parts in an extremely smooth manner and subject to little wear of the moving parts.

Another object and advantage of the present invention is that it permits a hi-hat cymbal assembly to be readily tiled or angled from a 0° horizontal up to approximately 45° and any angle in between without subjecting the instrument to substantial wear, bending or a tendency to tip over.

Another object and advantage of the present invention is that the biasing spring urging the cymbals apart is located in the hi-hat cymbal assembly between the cymbals thereby creating an extremely responsive instrument and not requiring additional complex biasing structures to be located in the lower treadle stand.

Another object and advantage of the present invention is that the spacial difference between the cymbals of the hi-hat cymbal assembly may be easily adjustable between approximately 1¼" to 3".

Another object and advantage of the variable angled hi-hat percussion instrument is that it permits the hi-hat cymbal assembly to be tilted to make it easier to play for the drummer without worry of striking the cymbals along their edges and wearing of the drum sticks.

Other objects and advantages will become apparent upon a reading of the following specification, claims and a review of the figures.

BRIEF DESCRIPTION OF THE DRAWINGS

FIG. 10 is a partially broken away view of the pivoting knuckle taken along lines 10—10 of FIG. 8;

FIG. 13 is a view showing the hi-hat cymbal assembly of the present invention in operation and partially broken away;

FIG. 16 shows that multiple pivoting knuckles may be utilized to create a variable angled hi-hat percussion instrument;

FIG. 17 shows that the biasing means may be a substantially cylindrical spring; and FIG. 18 shows that the biasing means may be leaf or hoop springs.

DETAILED DESCRIPTION OF THE PRESENT INVENTION

Figures 1, 2, 3:
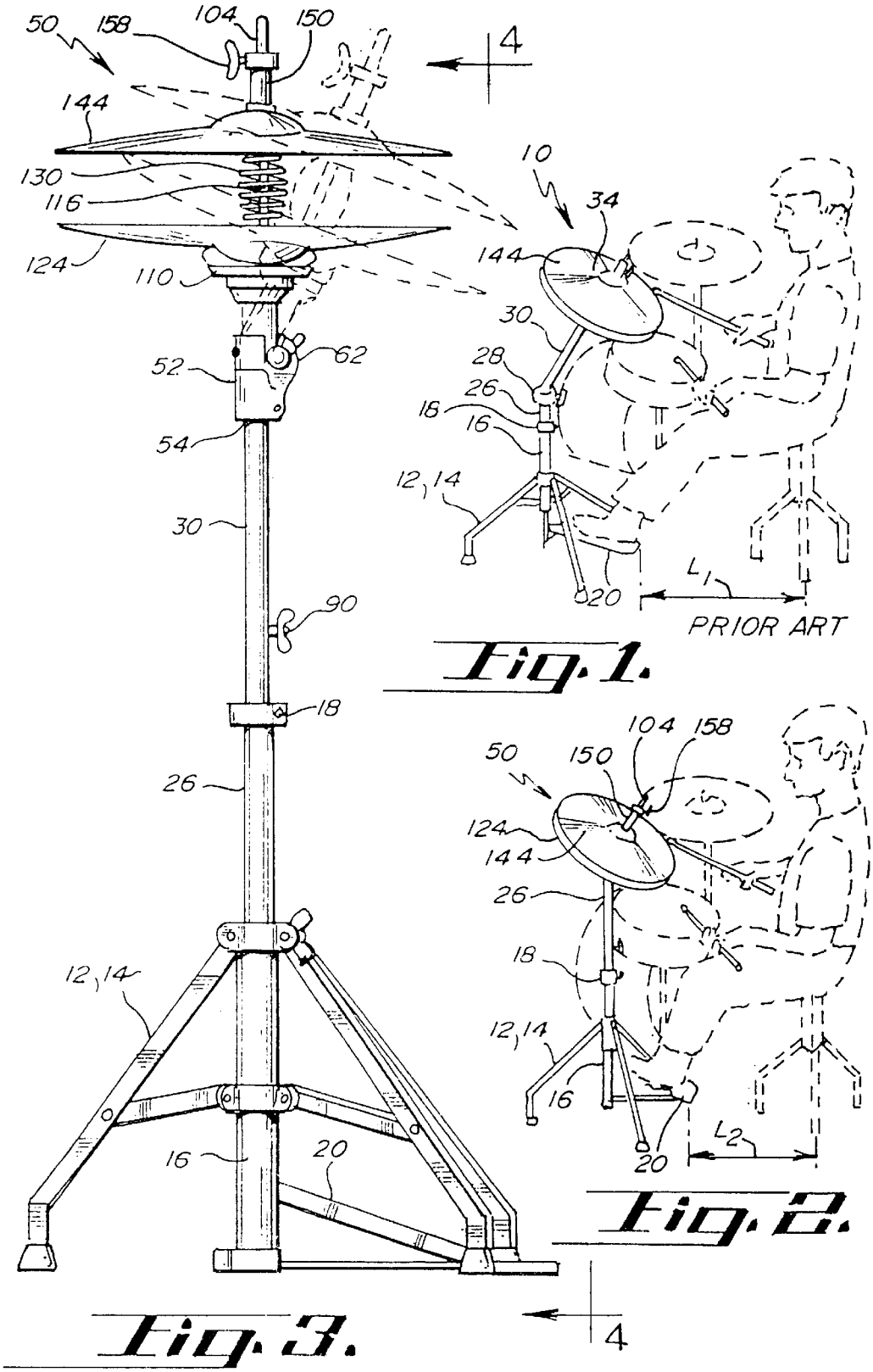
FIG. 1 is a prior art figure demonstrating the problem of tilting the hi-hat cymbal assembly which results in the great distance to the pedal of the treadle stand.
FIG. 2 is a figure of the improved hi-hat percussion instrument of the present invention showing both the cymbal assembly and the foot pedal of the treadle stand being relatively close to the drummer.
FIG. 3 is a side elevation of the present invention.
Figure 5:
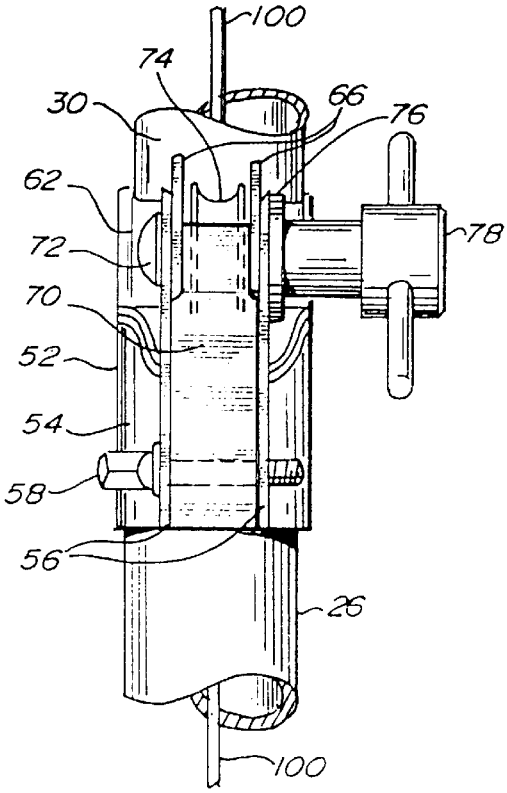
FIG. 5 is a broken away enlarged view of the pivoting knuckle shown in FIG. 4 of the present invention.

Referring to the figures, the components of hi-hat percussion instruments may generally be reviewed. Such percussion instruments make music by shaking or clanging together to also include cup chimes and tambourines. A typical hi-hat percussion instrument 10 is comprised of a treadle stand 12. The stand 12 includes a tripod 14 with a central or support shaft 16 carrying a clamp 18 at its upper portion. The foot pedal or actuator 20 is connected to a lower rod 22 (FIG. 7) which passes upwardly through the central shaft 16 to connect to a union and further to a lower standard hi-hat support shaft 26. The hi-hat shaft 26 has a slot 27 for access to connect the lower rod 22 to the upper working components of the hi-hat support shaft 26. A pivoting knuckle or hinge 28 may be provided for tilting the hi-hat instrument 10 supported on an upper or second standard hi-hat support shaft 30 which also may have a slot 31 (FIG. 4) therein. A cymbal pedestal then supports hi-hat cymbal assembly 34.

Figure 4:
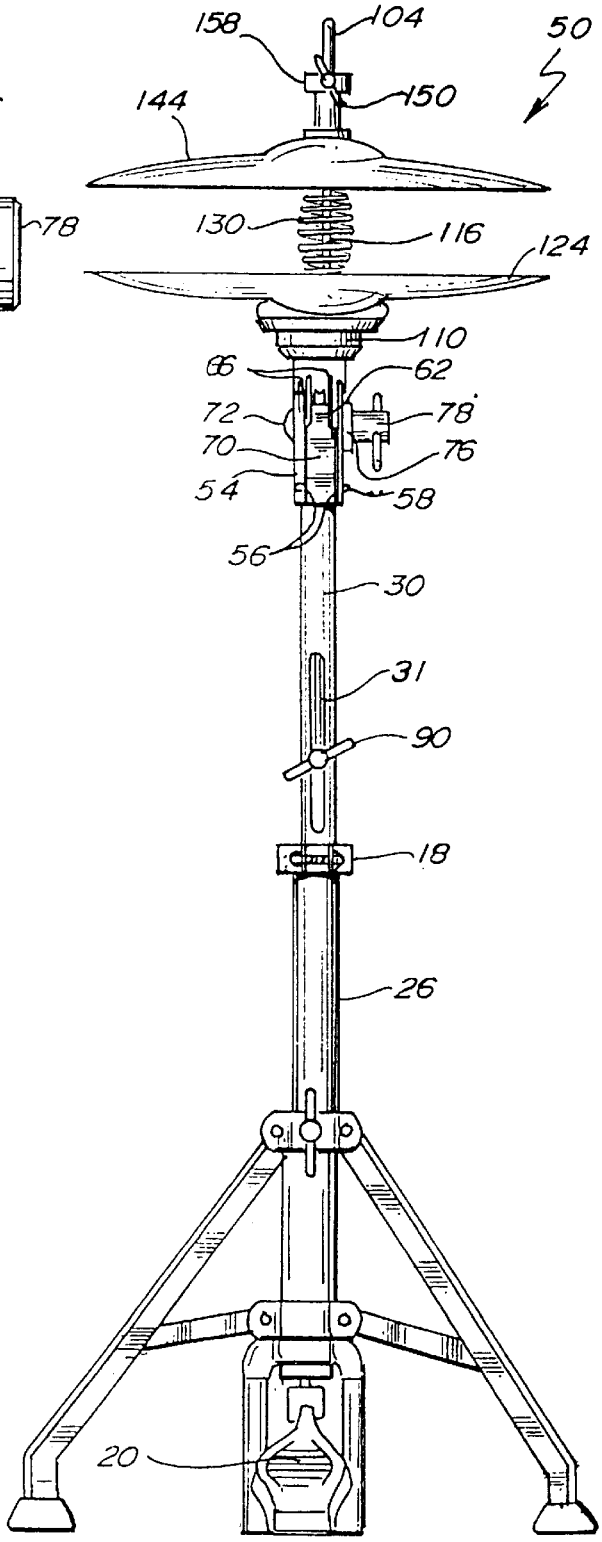
FIG. 4 is a view taken along lines 4—4 of FIG. 3 showing the present invention as facing the drummer.

The variable angle hi-hat percussion instrument 50 of the present invention shown in FIGS. 3 and 4 generally includes treadle stand 12 with one or both standard hi-hat support shafts 26 or 30. Illustratively, the upper shaft supports the unique pivoting knuckle assembly 52 of the present invention to permit the cymbal assembly to be tilted suitably up to 45°. A flexible member 100 (FIGS. 6 and 7) is connected by way of a connector 86 to the lower rod 22 of the treadle stand 12. The flexible member 100 passes through the cymbal pedestal 110 and the threaded fixed shaft 116 and is secured or captured by the clutch or barrel assembly 150. The cymbals 124 and 144 are also captured on the fixed shaft 116 with the lower cymbal 124 being fixed. The fixed shaft 116 also carries the biasing means or spring 130 between cymbals 124 and 144.

Now turning to the details of the invention, please refer to FIGS. 2 through 13. The variable angle hi-hat percussion instrument 50 has a novel pivoting knuckle or hinge 52. The knuckle 52 has a lower pivot housing 54 securable to the central shaft 16 or the lower standard hi-hat support shaft 26 depending upon the application. The pivot housing 54 has pivot flanges 56 and a lower tightening screw 58 securing the housing 54 about the shafts 26 or 16. The upper pivot housing 62 includes a set screw 64 for securing the knuckle 52 either to the upper standard hi-hat support shaft 30 or the base of the cymbal pedestal 110 depending upon application. Housing 62 further includes flanges 66 which are co-extensive and adjacent to flanges 56 and a pivot aperture passes through flanges 56 and 66. The lower tightening screw 58 also captures a friction foot 70 which aligns between flanges 56 and 66. The threaded pivot pin 72 passes through the flanges 56 and 66 and also supports a pulley with bearing 74. The pin 72 may then carry a washer 76 external of the lower flange 56 after which a tightener or wing nut 78 may be secured to pin 72.

By this arrangement, the hand tightener 78 may be initially loosened to permit the knuckle 52 to be swung in an angle from 0° to approximately 45°. Thereafter, the tightener 78 is tightened on pivot pin 72 causing friction foot 70 to further impinge upon flanges 56 and 66 to thereby hold the hi-hat percussion instrument 50 in its suitable varied angle.

Figure 6:
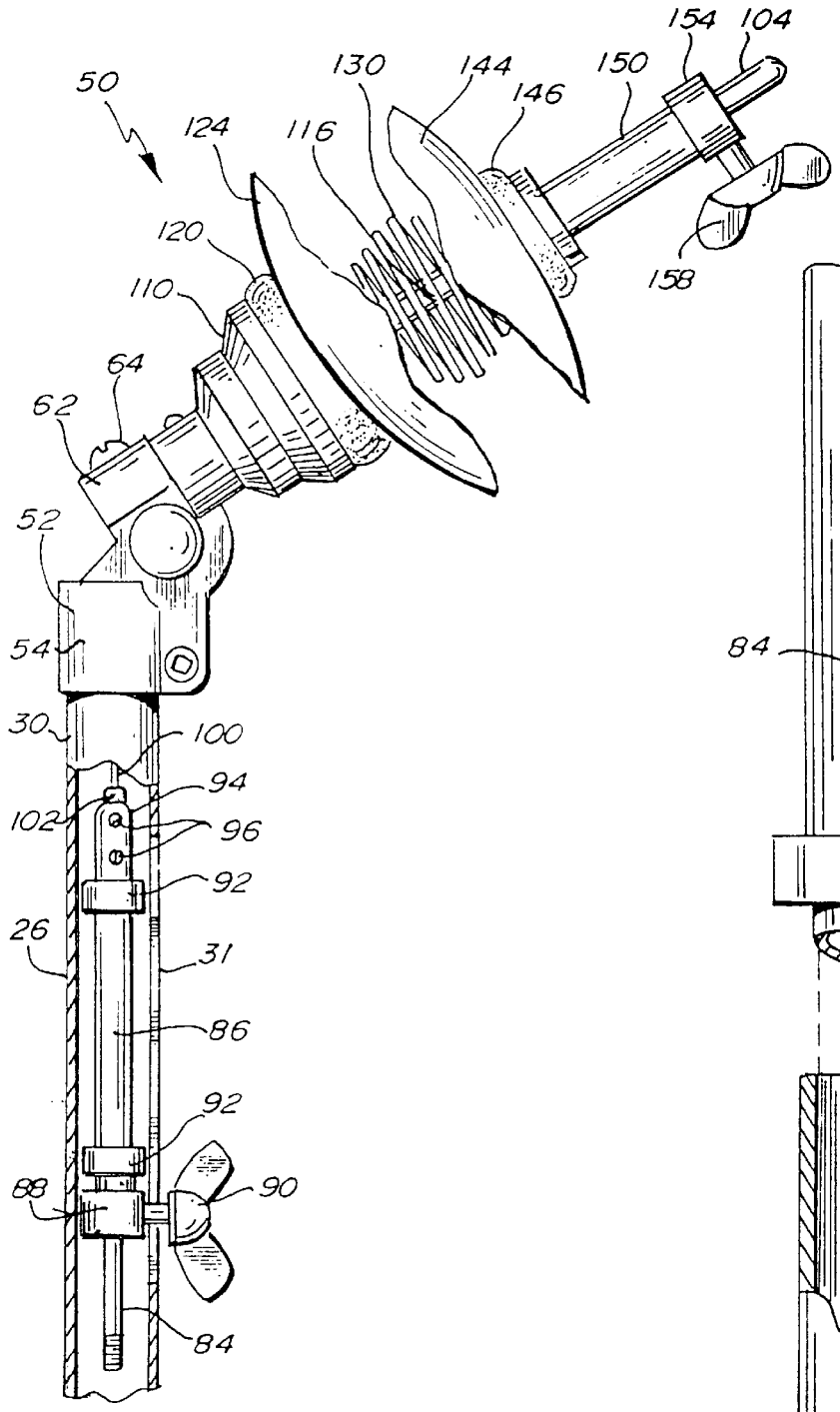
FIG. 6 is a partially broken away side elevational view enlarged from FIG. 3.
Figure 7:
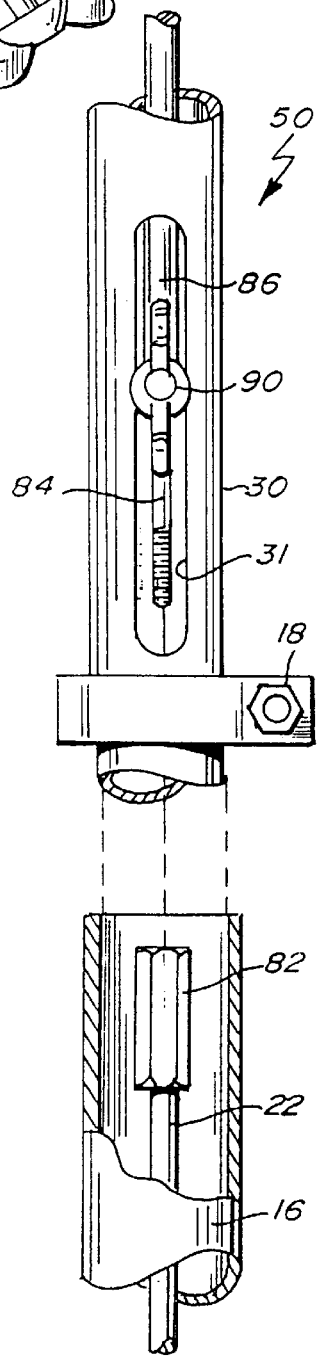
FIG. 7 is an exploded and broken away elevational view of the standard hi-hat shaft telescoping into the central support shaft of the treadle stand.

FIGS. 6 and 7 illustrate how the treadle stand 12 with its shaft 16 will readily connect to a standard hi-hat support shaft 26 or 30 adapted with the improvements of applicant's invention. Specifically, the lower rod 22 has a union 82 thereon which will receive the lower rod extension 84 by threading engagement. The lower rod extension 84 is connected to the hub end 88 of the connector or connector rod 86. A knobbed set screw 86 then permits securement of the lower rod extension 84 for operable connection of the treadle shaft 16 and lower rod 22 to the standard hi-hat support shaft 30. The connector 86 suitably has nylon washers 92 to permit smooth upward and downward movement of the connector when operating the instrument 50. The cable end 94 of the connector 86 is hollow and receives set screws 96. The flexible member, which may be a wire, cable, chain, plastic, etc., has a bottom anchor post 102 and a top anchor post 104. The bottom anchor post 102 is received into the cable end 94 of the connector 86 and set screws 96 are secured in place to capture the anchor post 102.

Figure 8:
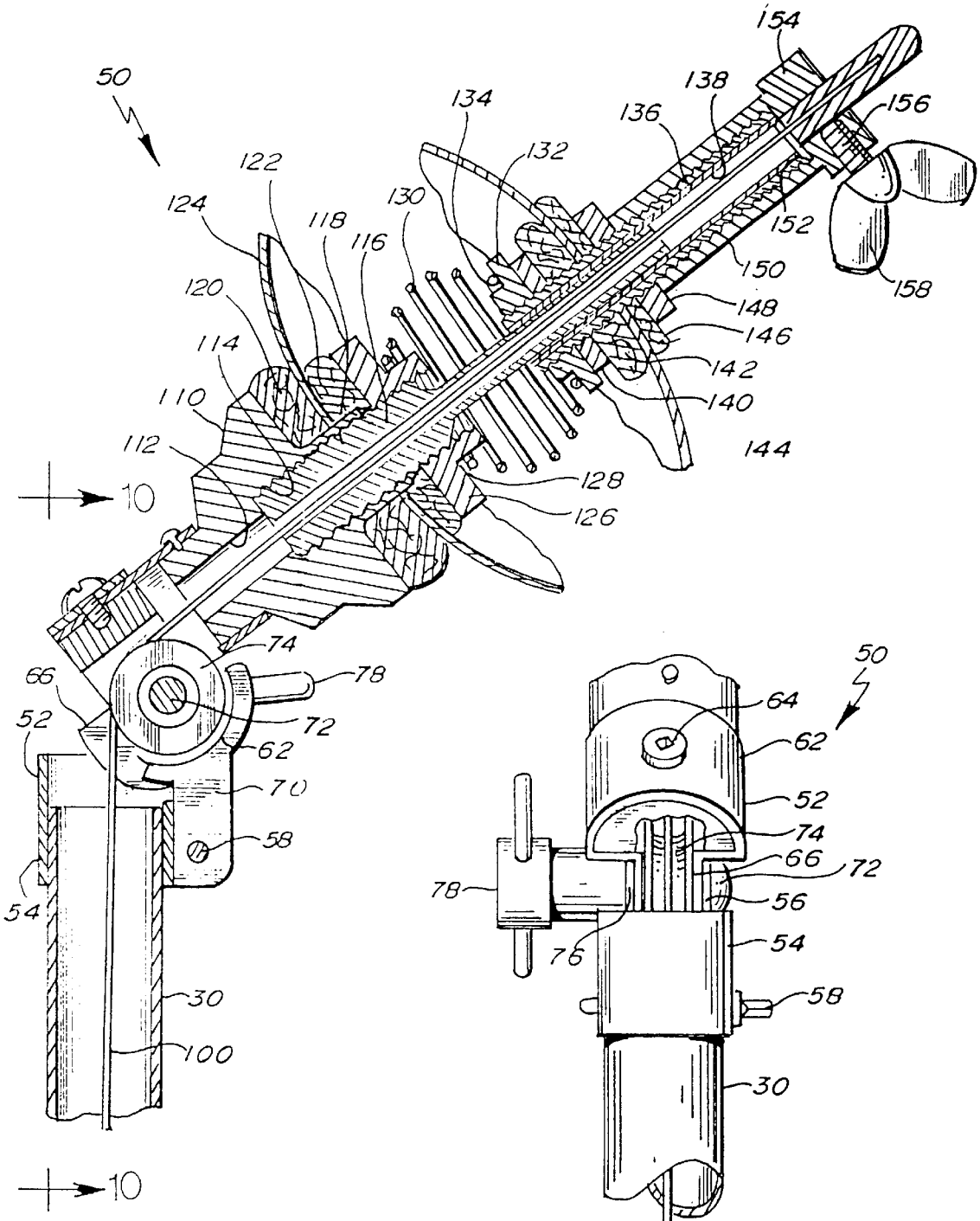
FIG. 8 is a cross-sectional view of the hi-hat cymbal assembly partially broken away.
Figures 9, 15:
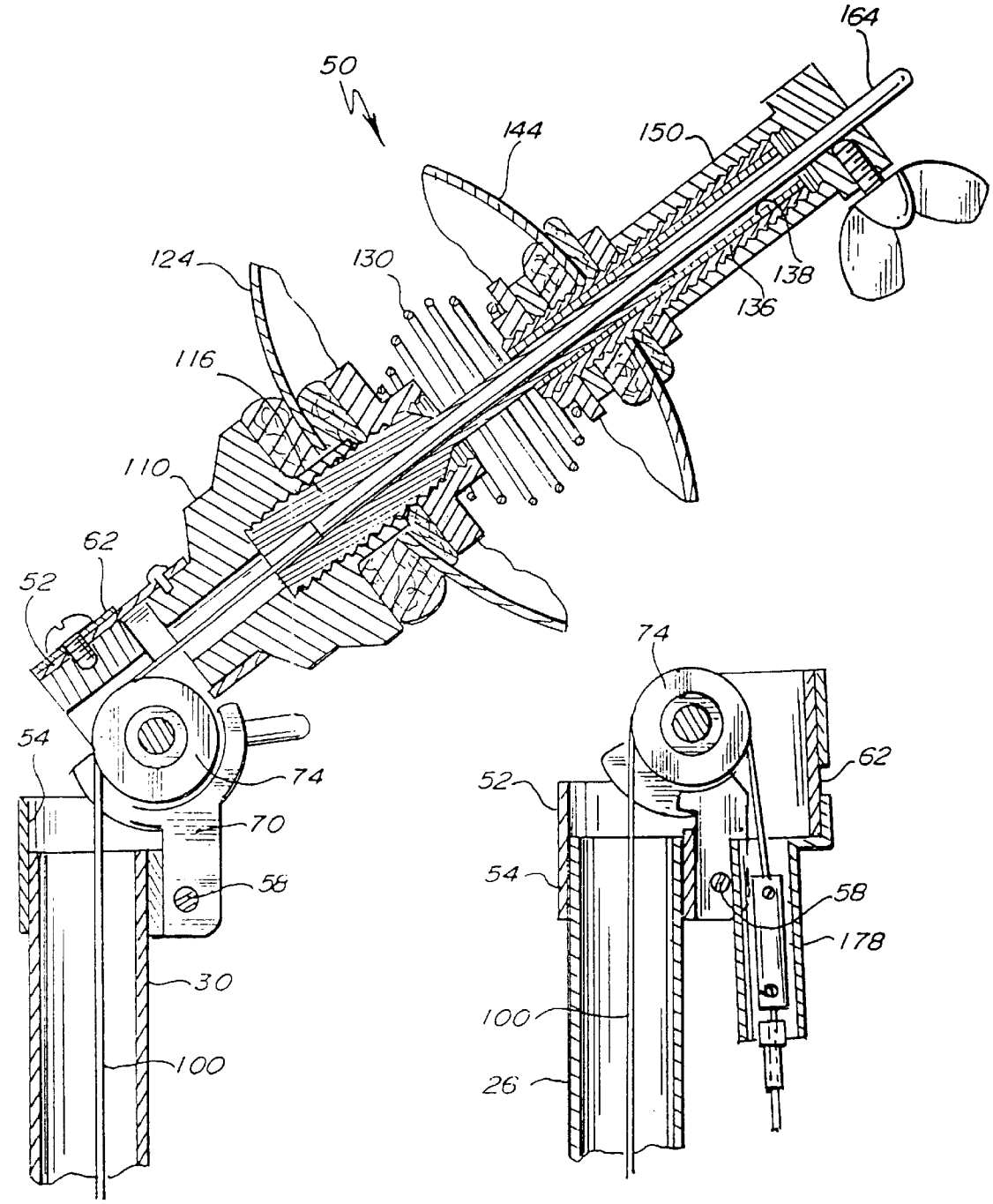
FIG. 9 is also a cross-sectional view similar to FIG. 8 with an elongated anchor post connected to the flexible member.
FIG. 15 illustrates that the pivoting knuckle of the present invention may be used with the remote hi-hat system of FIG. 14.
Figure 11:
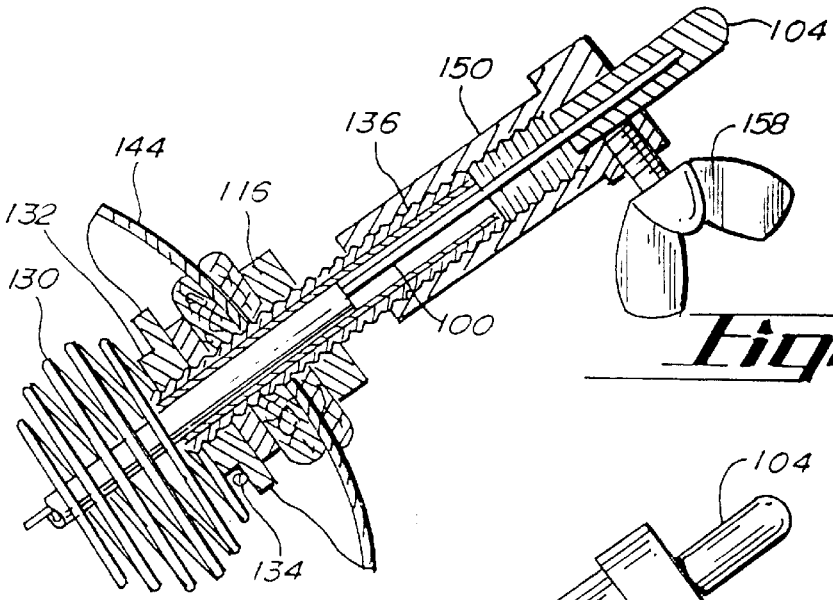

Flexible member 100 then extends upwardly from connector 86, through pivoting knuckle 52 and about bearing pulley 74 (FIGS. 8 to 10). From pulley 74, the flexible member extends upward through the cymbal pedestal 110, particularly through central opening 112 which has a threaded upper portion 114. Threaded upper portion 114 of pedestal 110 then receives threaded fixed shaft 116 at its threaded end 118.

Next, a large felt washer 120 is passed onto and surrounds the fixed shaft 116 adjacent the pedestal 110 which will then support and receive the lower cymbal 124 followed by another small felt washer 122. Thereafter, a lower threaded washer 126 is threaded onto the exposed threaded end 118 of the fixed shaft 116. The threaded washer 126 has a spring seat or flange 128 which receives spring 130 which is somewhat bulbous at the center. The purpose for this is to permit the spring to readily compress further to permit more travel of the upper cymbal 144. Also, the bulbous spring 130 will not so readily kink one way or another which otherwise may make undesirable sounds along the threaded fixed shaft 116 during the play of the instrument 50. Further, the bulbous spring permits it to telescope upon itself upon compression.

Spring tension threaded washer 132 with its spring seat or flange 134 next goes over fixed shaft 116 and is threaded onto the threaded barrel insert 136. The threaded barrel insert 136 has an inner bronze bushing 138 which may be oil impregnated.

Next, the first upper threaded cymbal washer 140 is threaded onto the threaded barrel insert 136 after which a felt washer 142 is put in place over the barrel insert 136. Next, upper cymbal 144 is put in place after which felt washer 146 is slid over barrel insert 136. Thereafter, the second upper threaded washer 148 is threaded onto the threaded barrel insert 136. Next, the threaded barrel insert 136 is threadably connected to barrel or clutch 150 which has a threaded interior 152 which receives the insert 136. The barrel 150 has an upper hub 154 with a threaded radial aperture 156. The top anchor post 104 of the flexible member 100 is further fed all the way through the fixed shaft 116 up to the upper hub section 154 of barrel 150 and set thumb screw 158 is secured thereby completing the assembly of hi-hat percussion instrument 50.

It is to be noted in FIG. 9, which is similar to FIG. 8, there may be an extended top anchor post 164 which slides substantially through the fixed shaft 116 as opposed to the flexible member 100 extending through shaft 116.

Figure 11:
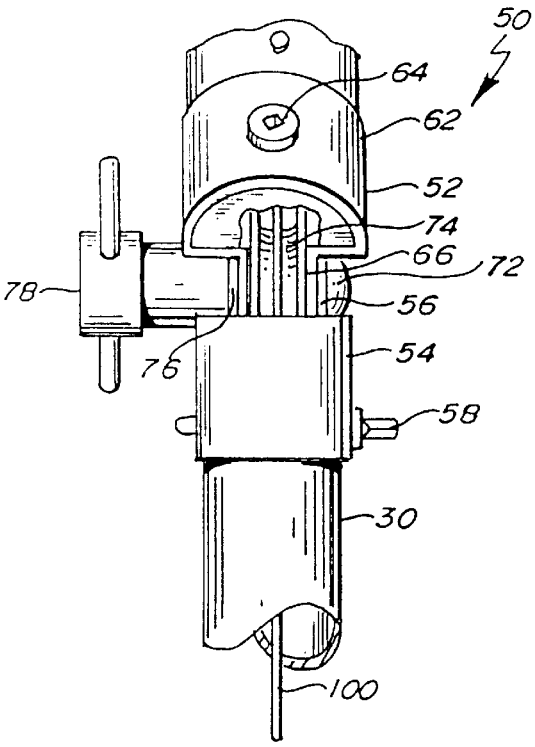
FIG. 11 is a view of the top portion of the hi-hat cymbal assembly illustrating that the distance between the cymbals may be varied.
Figure 12:
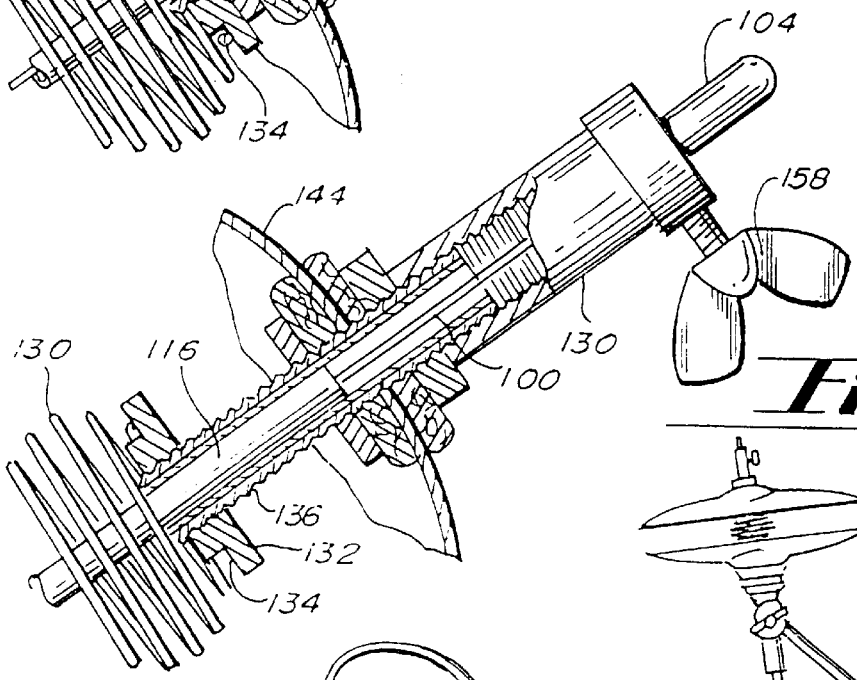
FIG. 12 is a view similar to FIG. 11 demonstrating that the tension on the spring between the cymbals may be increased or decreased depending upon the weight of the cymbals.

FIGS. 11 and 12 illustrate the adjustability of the novel hi-hat assembly. To move the upper cymbal 144 closer to the lower cymbal 124, the threaded barrel insert 136 may be rotated outwardly from the barrel 150. Another adjustment shown in FIG. 12 is that the spring tension threaded washer 132 may compress the spring 130 which is suitable for heavier cymbal operation in the instrument 50.

FIG. 13 shows the operation of the instrument 50. As the foot pedal 20 is stepped down, the lower rod 22, connector 86 and flexible member 100 pulls downwardly, also moving clutch/barrel assembly 150 with upper cymbal 144 toward and engaging the lower cymbal 124. This operation may be performed while the knuckle 52 is at a varied angle.

Figure 14:
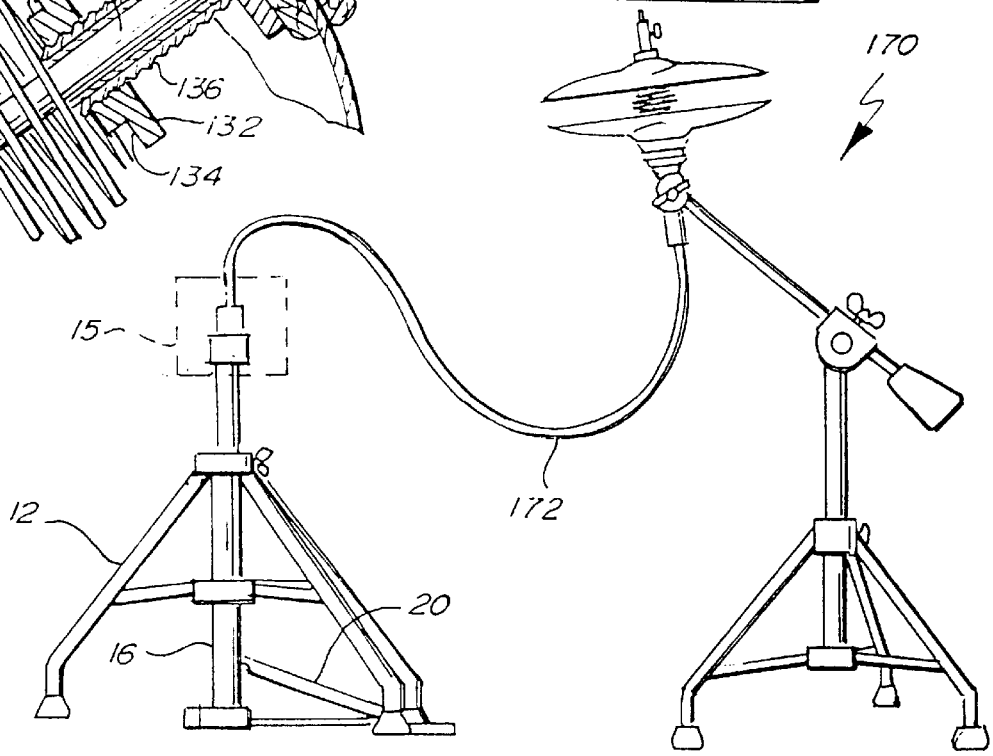
FIG. 14 illustrates the improved hi-hat percussion instrument of the present invention with a remotely mounted hi-hat cymbal assembly connected to the treadle stand by a cable.

FIG. 14 shows a remote hi-hat percussion instrument 170. Specifically, the treadle stand 12 has a flexible cable with jacket 172 extending over to a remote support arm which supports a hi-hat cymbal assembly. FIG. 15 taken from FIG. 14 shows that the knuckle assembly 52 of the present invention may be utilized to direct the flexible cable 172 downwardly toward the floor and away from the drum set.

FIG. 16 shows a multiple knuckle variable hi-hat percussion instrument 180 with at least two knuckles 52. Thus, the instrument 180 can rotate along axis a as shown by arrow A; along axis b as shown by arrow B; along axis c as shown in arrow C; and along axis d by arrow D.

FIGS. 17 and 18 show that the hi-hat cymbal assembly of the present invention may utilize the straight cylindrical spring 184 as well as a bow or leaf spring or springs 186 to bias the cymbals apart.

I claim:

1. An improved hi-hat percussion instrument for a treadle stand with a foot pedal, the improvement comprising:

a) a hi-hat cymbal assembly with a lower fixed cymbal and a moveable upper cymbal;

b) bias means between the cymbals urging the cymbals apart;

c) a member connected to the foot pedal and to the movable top cymbal; and, d) a hi-hat support shaft extending from the treadle stand; and e) a pivoting knuckle on top of the hi-hat support shaft connected to the lower fixed cymbal for tilting the cymbal assembly.

2. The improved hi-hat percussion instrument of claim 1, wherein the knuckle comprises pivotally connected upper and lower housings being frictionally engageable and supporting a pulley therebetween.

3. The improved hi-hat percussion instrument of claim 2, wherein the housings each have co-extensive flanges supporting the pulley and having a friction engaging foot between the flanges which will permit the hi-hat cymbal assembly to assume variable angles.

4. The improved hi-hat percussion instrument of claim 3, further comprising a hand-tightenable pivot pin extending through the flanges and supporting the pulley.

5. The improved hi-hat percussion instrument of claim 1, wherein the member is flexible and has top and bottom anchor posts, the bottom anchor post adapted to be releasably connected to the foot pedal and the top anchor post adapted to be releasably connected to a clutch which holds the movable upper cymbal.

6. The improved hi-hat percussion instrument of claim 1, wherein the hi-hat cymbal assembly further comprises a pedestal supporting the lower fixed cymbal and a centrally located fixed shaft extending upwardly from the pedestal and through the lower cymbal.

7. The improved hi-hat percussion instrument of claim 6, wherein the member is flexible and extends through the pedestal into the fixed shaft, and is anchored to a barrel clutch movably supporting the upper cymbal on the fixed shaft.

8. The improved hi-hat percussion instrument of claim 6, wherein the member is flexible and connected to a barrel through the pedestal and the fixed shaft, the barrel movably supporting the upper cymbal on the fixed shaft.

9. The improved hi-hat percussion instrument of claim 6, wherein the bias means is supported on the fixed shaft.

10. The improved hi-hat percussion instrument of claim 6, wherein the member is flexible and connected to a barrel through the pedestal and the shaft, the barrel adjustably securing both the upper cymbal and the bias means comprised of a spring on the shaft, the spring located between the cymbals.

11. An improved hi-hat percussion instrument for a treadle stand with a foot pedal, the improvement comprising:

(a) a hi-hat cymbal assembly with a lower fixed cymbal and a movable upper cymbal, wherein the hi-hat cymbal assembly further comprises a pedestal supporting the lower fixed cymbal and a centrally located fixed shaft extending upwardly from the pedestal and through the lower cymbal;

(b) bias means between the cymbals urging the cymbals apart; and (c) a flexible member connected to the foot pedal and the movable top cymbal, wherein the flexible member is connected to a barrel through the pedestal and the fixed shaft, the barrel movably supporting the upper cymbal on the fixed shaft.

12. The improved hi-hat percussion instrument of claim 11, further comprising:

(a) a hi-hat support shaft extending from the treadle stand; and (b) a pivoting knuckle on top of the hi-hat support shaft connected to the lower fixed cymbal for tilting the cymbal assembly.

13. The improved hi-hat percussion instrument of claim 12, wherein the knuckle comprises pivotally connected upper and lower housings being frictionally engageable and supporting a pulley therebetween.

14. The improved hi-hat percussion instrument of claim 13, wherein the housings each have co-extensive flanges supporting the pulley and having a friction engaging foot between the flanges which will permit the hi-hat cymbal assembly to assume variable angles.

15. The improved hi-hat percussion instrument of claim 14, further comprising a hand-tightenable pivot pin extending through the flanges and supporting the pulley.

16. The improved hi-hat percussion instrument of claim 11, wherein the flexible member has top and bottom anchor posts, the bottom anchor post adapted to be releasably connected to the foot pedal and the top anchor post adapted to be releasably connected to the barrel which holds the movable upper cymbal.

17. The improved hi-hat percussion instrument of claim 11, wherein the bias means is supported on the fixed shaft.

18. The improved hi-hat percussion instrument of claim 11, wherein the flexible member is connected to a barrel through the pedestal and the shaft, the barrel adjustably securing both the upper cymbal and the bias means comprised of a spring on the shaft, the spring located between the cymbals.

19. A variable angle hi-hat percussion instrument for a treadle stand with a foot pedal, the instrument comprising:

(a) a hi-hat cymbal assembly with a lower fixed cymbal and a movable upper cymbal;

(b) a hi-hat support shaft extending from the treadle stand;

(c) a pivoting knuckle on top of the hi-hat support shaft connected to the lower fixed cymbal for tilting the cymbal assembly;

(d) bias means between the cymbals urging the cymbals apart; and (e) a flexible member connected to the foot pedal and the movable top cymbal.

20. The hi-hat percussion instrument of claim 19, wherein the knuckle comprises pivotally connected upper and lower housings being frictionally engageable and supporting a pulley therebetween.

21. The hi-hat percussion instrument of claim 20, wherein the housings each have co-extensive flanges supporting the pulley and having a friction engaging foot between the flanges which will permit the hi-hat cymbal assembly to assume variable angles.

22. The hi-hat percussion instrument of claim 21, further comprising a hand-tightenable pivot pin extending through the flanges and supporting the pulley.

23. The hi-hat percussion instrument of claim 19, wherein the flexible member has top and bottom anchor posts, the bottom anchor post adapted to be releasably connected to the foot pedal and the top anchor post adapted to be releasably connected to a barrel which holds the movable upper cymbal.

24. The hi-hat percussion instrument of claim 19, wherein the hi-hat cymbal assembly further comprises a pedestal supporting the lower fixed cymbal and a centrally located fixed shaft extending upwardly from the pedestal and through the lower cymbal.

25. The hi-hat percussion instrument of claim 24, wherein the flexible member extends through the pedestal into the fixed shaft, and is anchored to a barrel movably supporting the upper cymbal on the fixed shaft.

26. The hi-hat percussion instrument of claim 24, wherein the flexible member is connected to a barrel through the pedestal and the fixed shaft, the barrel movably supporting the upper cymbal on the fixed shaft.

27. The hi-hat percussion instrument of claim 24, wherein the bias means is supported on the fixed shaft.

28. The hi-hat percussion instrument of claim 24, wherein the flexible member is connected to a barrel through the pedestal and the shaft, the barrel adjustably securing both the upper cymbal and the bias means comprised of a spring on the shaft, the spring located between the cymbals.

29. A variable angle hi-hat percussion instrument for a treadle stand with a foot pedal, the instrument comprising:

(a) a hi-hat cymbal assembly with a lower fixed cymbal and a movable upper cymbal;

(b) a first hi-hat support shaft extending from the treadle stand and a second hi-hat support shaft extending from the first hi-hat support shaft;

(c) two pivoting knuckles, one connecting the two hi-hat shafts and a second on top of the second hi-hat support shaft connected to the lower fixed cymbal for tilting the cymbal assembly in more than one angle relative to the treadle stand;

(d) bias means between the cymbals urging the cymbals apart; and (e) a flexible member connected to the foot pedal and the movable top cymbal.

30. A remote hi-hat percussion instrument for a treadle stand with a foot pedal, the instrument comprising:

(a) a hi-hat cymbal assembly with a lower fixed cymbal and a movable upper cymbal, remotely supported from the treadle stand;

(b) bias means between the cymbals urging the cymbals apart; and (c) a flexible member connected to the foot pedal and the movable top cymbal.

31. An improved hi-hat percussion instrument for a stand with a pedal, the improvement comprising:

a) a hi-hat cymbal assembly with a fixed cymbal and a moveable cymbal;

b) bias means between the cymbals urging the cymbals apart;

c) a member connected to the foot pedal and to the movable cymbal; and, d) a pivoting knuckle on top of the hi-hat support shaft connected to the fixed cymbal for tilting the cymbal assembly.

32. The improved hi-hat percussion instrument of claim 31, wherein the knuckle comprises pivotally connected upper and lower housings being frictionally engageable and supporting a pulley therebetween.

33. The improved hi-hat percussion instrument of claim 32, wherein the housings each have co-extensive flanges supporting the pulley and having a friction engaging foot between the flanges which will permit the hi-hat cymbal assembly to assume variable angles.

34. The improved hi-hat percussion instrument of claim 33, further comprising a hand-tightenable pivot pin extending through the flanges and supporting the pulley.

35. The improved hi-hat percussion instrument of claim 31, wherein the member is flexible and has top and bottom anchor posts, the bottom anchor post adapted to be releasably connected to the foot pedal and the top anchor post adapted to be releasably connected to a clutch which holds the movable upper cymbal.

36. The improved hi-hat percussion instrument of claim 31, wherein the hi-hat cymbal assembly further comprises a pedestal supporting the fixed cymbal and a centrally located fixed shaft extending upwardly from the pedestal and through the fixed cymbal.

37. The improved hi-hat percussion instrument of claim 36, wherein the member is flexible and extends through the pedestal into the fixed shaft, and is anchored to a barrel clutch movably supporting the moveable cymbal on the fixed shaft.

38. The improved hi-hat percussion instrument of claim 36, wherein the member is flexible and connected to a barrel through the pedestal and the fixed shaft, the barrel movably supporting the moveable cymbal on the fixed shaft.

39. The improved hi-hat percussion instrument of claim 36, wherein the bias means is supported on the fixed shaft.

40. The improved hi-hat percussion instrument of claim 36, where the member is flexible and connected to a barrel through the pedestal and the shaft, the barrel adjustably securing both the moveable cymbal and the bias means comprised of a spring on the shaft, the spring located between the cymbals.

* * * * *